United States Patent [19]

Giometti

[11] Patent Number: 5,050,441

[45] Date of Patent: Sep. 24, 1991

[54] ENGINE STARTER GEARING

[75] Inventor: Paul F. Giometti, Horseheads, N.Y.

[73] Assignee: Purolator Products Company, Tulsa, Okla.

[21] Appl. No.: 601,468

[22] Filed: Oct. 22, 1990

[51] Int. Cl.[5] ..... F02N 11/00

[52] U.S. Cl. ..... 74/7 C; 74/6; 192/104 R; 192/114 R

[58] Field of Search ..... 74/6, 7 A, 7 C; 192/103 A, 104 R, 114 R

[56] References Cited

U.S. PATENT DOCUMENTS

| | | | |
|---|---|---|---|
| 4,611,499 | 9/1986 | Giometti | 74/6 |
| 4,712,435 | 12/1987 | Losey et al. | 74/6 |
| 4,715,239 | 12/1987 | Giometti | 74/7 A |
| 4,768,392 | 9/1988 | Giometti | 74/6 |
| 4,777,836 | 10/1988 | Giometti | 192/104 R |
| 4,843,897 | 7/1989 | Tallis, Jr. | 74/6 |
| 4,912,991 | 4/1990 | Giometti | 74/6 |

*Primary Examiner*—Allan D. Herrmann
*Assistant Examiner*—Julie Krolikowski
*Attorney, Agent, or Firm*—Remy J. VanOphem

[57] ABSTRACT

A centrifugally disengageable engine starter gear of the positive shift type that has a clutch to provide for driving and indexing of the starter gear, an internal mechanism keeps the clutch teeth in engagement during the indexing function, and a centrifugal separator separates the clutch teeth in an overrunning condition. The separator includes a plurality of flyweight members disposed in a like plurality of flyweight recesses provided in a driven member of the clutch. Radial displacement of the plurality of flyweight members axially displaces a thrust washer to separate the clutch teeth. A projection extending longitudinally from each web which separates the flyweight recesses prevents the flyweight members from disengaging from the flyweight recesses during an overrunning mode.

30 Claims, 4 Drawing Sheets

ENGINE STARTER GEARING

BACKGROUND OF THE INVENTION

1. Field of the Invention

The present invention generally relates to engine starter gearing for an engine. More specifically, this invention relates to engine starter gearing of a positive shift type, including a dentil clutch to provide driving and overrunning features and further including provisions for effecting the automatic separation of the clutch teeth after the engine becomes self-running.

2. Description of the Prior Art

The present invention is an improvement over U.S. Pat. No. 4,611,499 entitled "Engine Starter Gearing", issued September, 1986, to Giometti, and assigned to the assignee hereof, as well as a further improvement over the starter gearing system described in U.S. Pat. No. 3,263,509 entitled "Engine Starter Drive", issued Aug. 2, 1966, to Digby.

The Digby patent disclosed an engine starter gearing using centrifugal weights and a conical thrust washer for separating dentil clutch teeth after engine start-up to prevent long periods of clutch overrunning and accompanying deleterious wear on the clutch teeth. An annular recess is formed in a driving clutch member. A circular recess is provided in the face of a driven clutch member facing the driving clutch member. An annular thrust washer is fitted in the annular recess and abuts the driving clutch member. A conical surface is provided on the annular thrust washer facing the driven clutch member.

A plurality of centrifugal flyweight members are also provided in the circular recess. The centrifugal flyweight members are provided with an inclined surface cooperating with the conical surface in the annular thrust washer, such that, when an overrunning condition occurs, the centrifugal flyweight members move radially outwardly and the inclined surface engages the conical surface of the annular thrust washer so as to bias the driving clutch member away from the driven clutch member. The centrifugal flyweight members are prevented from axial or rotational movement with respect to the driven clutch member by pins extending through suitable bores in the driven clutch member and the centrifugal flyweight members.

While the engine starter gearing of Digby has been satisfactory in operation, it is difficult and expensive to assemble. This is true because a plurality of movable pins and centrifugal flyweight members must be somehow maintained in position relative to the driven clutch member during the assembly of the driven clutch member to the driving clutch member.

Furthermore, the weight and, therefore, the effectiveness of the centrifugal flyweight members is reduced by the existence of a substantial bore therethrough, in comparison to the size of the centrifugal flyweight members, for admission of the pin. The bore through the centrifugal flyweight members further reduces the strength of the centrifugal flyweight members and, accordingly, limits the materials and dimensions which may advantageously be used for the centrifugal flyweight members.

The embodiment of FIGS. 3 and 4 of U.S. Pat. No. 4,611,499 to Giometti solved many of the aforementioned engine starter gearing disadvantages, but such an embodiment requires the use of a driven clutch member whose circular recess is difficult to machine. As solutions thereto, U.S. Pat. No. 4,712,435 to Losey et al, U.S. Pat. No. 4,768,392 to Giometti, and U.S. Pat. No. 4,843,897 to Tallis Jr. disclosed various forms of annular inserts. Each of the disclosed annular inserts provided flyweight guides for guiding the flyweight members when they travel radially as a result of a centrifugal force produced during an overrunning condition. As such, the use of the annular inserts eliminated the requirement for precision machining of the circular recess of the driven clutch member.

However, in practice it has been determined that the flyweight guides of the latter patents cited are not adapted to limit the axial travel of the flyweight members as could the pin arrangement taught by Digby. As a consequence, during the overrunning condition the annular thrust washer can at times be forced back sufficiently by the interaction of the inclined surface of the flyweight members with the conical surface of the annular thrust washer to allow the flyweight members to travel axially toward the annular thrust washer until the flyweight members are beyond the flyweight guides. The flyweight members are then able to escape the flyweight guides and migrate circumferentially around the perimeter of the circular recess of the driven clutch member. Testing has indicated that this phenomenon results in momentary slipping between the driving and driven clutch members, causing high peak torques which are capable of twisting the mounting shaft splines.

Therefore, what is needed is an improved engine starter gearing using a centrifugal flyweight clutch separator which is capable of retaining the flyweight members as they travel in both the radial and axial directions such that the flyweight members are prevented from circumferentially migrating around the circular recess of the driven clutch member under all operating conditions. Furthermore, what is needed is such an engine starter gearing having a more solid, compact, and durable configuration for the centrifugal flyweight member which simplifies the manufacturing operations involved in manufacturing such engine starter gearing, particularly in regard to the driven clutch member component thereof.

SUMMARY OF THE INVENTION

The present invention provides a novel and improved engine starter gearing having a centrifugal weight clutch separator with solid unitary centrifugal flyweight members which can be readily manufactured and assembled to the engine starter gearing. Of primary importance, the engine starter gearing of the present invention provides longitudinal projections which, in conjunction with retaining surfaces associated with the driven clutch member, are capable of fully retaining the flyweight members as they travel in the axial direction. The flyweight members are thereby prevented from circumferentially migrating around the circular recess of the driven clutch member under all foreseeable operating conditions.

In particular, the engine starter gearing of the present invention provides a power shaft, a sleeve slidably secured to the power shaft, and helical splines on one extremity of the sleeve. A pinion gear is slidably journaled to the power shaft for axial movement relative thereto, the pinion gear being structured for movement into and out of engagement with the starting gear of the engine to be started. A driven clutch member is secured to the pinion gear for movement therewith. A circular recess is located in the driven clutch member. A driving clutch member is slidably mounted on the helical splines of the sleeve. The driving and driven clutch members have complementary mutually engageable inclined teeth for transmitting torque therebetween in one direction of relative rotation.

A housing is slidably supported on the sleeve and is provided with an open end such that the barrel housing may be fitted over the driving and driven clutch members. The driving and driven clutch members are contained within the housing by abutment means. A resilient member is disposed within the housing and abuts the driving clutch member so as to bias the driving clutch member against the driven clutch member, thereby engaging the mutually engageable inclined teeth of the driving and driven clutch members. A radially inwardly extending shoulder is formed on the driving clutch member adjacent the recess formed in the driven clutch member. An annular thrust ring having an inner conical surface is loosely disposed in the circular recess in the driven clutch member. The annular thrust ring is structured to abut the radially inwardly extending shoulder of the driving clutch member when displaced in a first direction.

A plurality of centrifugal flyweight members are annularly arranged in the circular recess in the driven clutch member. The plurality of centrifugal flyweight members each have an inclined surface abutting the conical surface of the annular thrust ring. The plurality of centrifugal flyweight members are operative to displace the annular thrust ring in a first axial direction in response to centrifugal force.

A plurality of cavities are formed in an annular sleeve which is inserted into the circular recess of the driven clutch member. The annular sleeve is provided to be non-rotatable relative to the driven clutch member. Each of the cavities has a pair of retaining surfaces which extend longitudinally in relation to the power shaft axis and which slidably receive therebetween at least a portion of its associated centrifugal flyweight member to prevent its circumferential movement while permitting radial movement thereof.

In the preferred embodiment of the present invention, the annular sleeve is provided with longitudinal projections extending from each of the longitudinal retaining surfaces and toward the annular thrust ring. The projections ensure circumferential restraint of each of the flyweight members when at the extreme limit of their longitudinal travel towards the annular thrust ring.

Accordingly, it is an object of the present invention to provide an engine starter gearing having a centrifugal flyweight clutch separator in which the flyweight members are prevented from migrating circumferentially from their containment cavities when the flyweight members are at the extreme limit of their longitudinal travel capability. The present invention accomplishes this object by providing a plurality of longitudinal projections formed integrally with an annular sleeve which resides within the driven clutch member. The annular sleeve retains each of the flyweight members within a cavity which allows limited radial displacement during an overrunning condition in the operation of the engine starter gearing, but does not restrain the flyweight members from being longitudinally displaced. The longitudinal projections are of sufficient length such that at the extreme longitudinal limit of the flyweight members' travel, the flyweight members remain retained within their respective cavities and are unable to migrate out between the driving clutch member and the driven clutch member.

It is a further object of this invention to provide an engine starter gearing which is easy to assemble. The present invention accomplishes this object by providing a plurality of unitary centrifugal flyweight members each directly engageable with an annular sleeve within the driven clutch member so as to reduce the number of components which must be secured together during assembly and reduce the complexity of the fabricating steps that must be followed to properly manufacture such components.

It is still a further object of this invention to provide engine starter gearing having a centrifugal flyweight clutch separator with strong centrifugal flyweight members. The present invention satisfies this object by providing unitary flyweight members without cavities formed therein, such that the flyweight members may be formed of a wide variety of available materials.

Other objects and advantages of this invention will be more apparent after a reading of the following detailed description taken in conjunction with the drawings provided.

DETAILED DESCRIPTION OF THE PREFERRED EMBODIMENT

Figure 1:
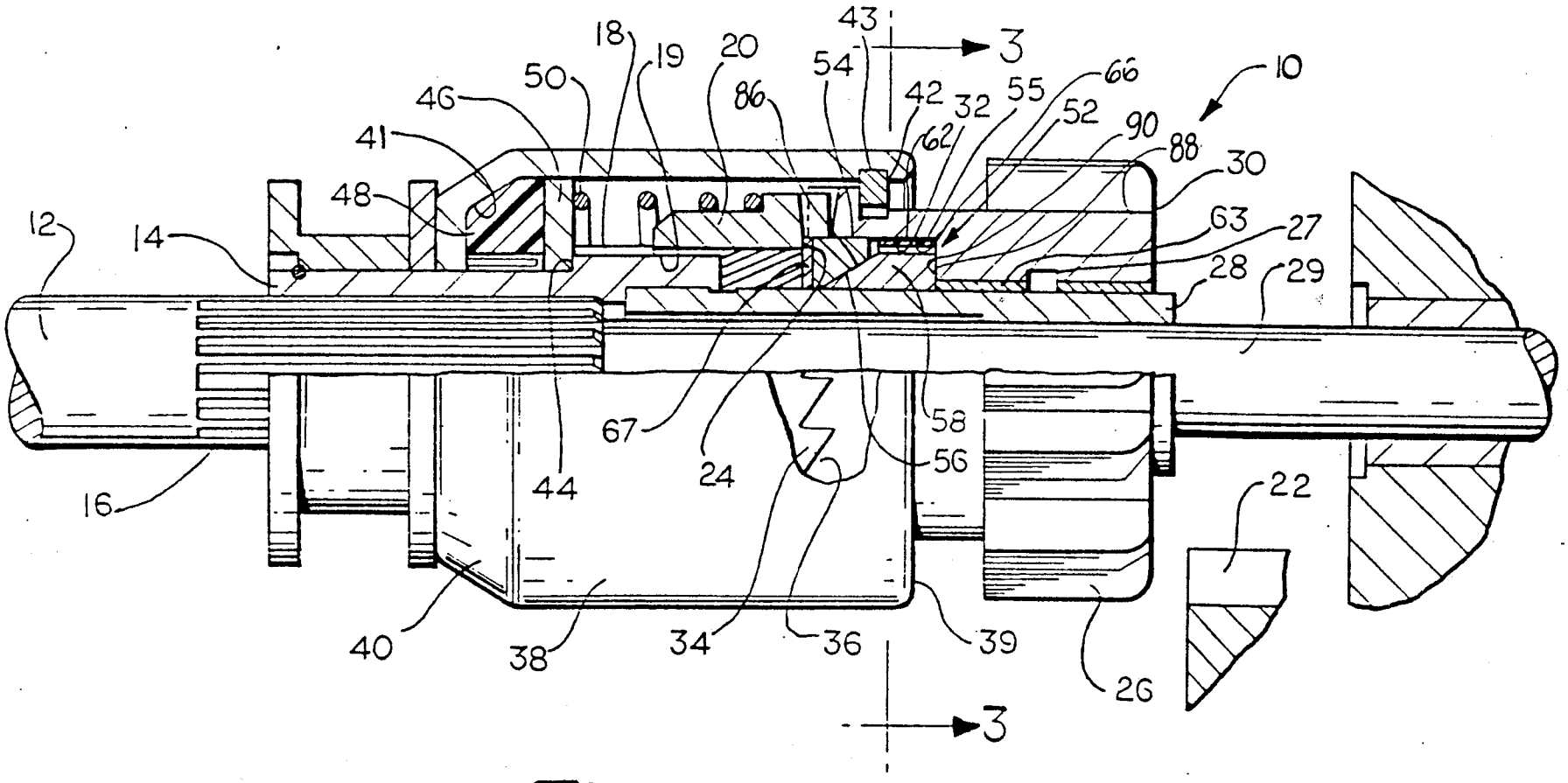
FIG. 1 is a side elevational view, partly broken away and partly in section, of the preferred embodiment of structure for an engine starter gearing according to the present invention.

Referring to FIG. 1, there is provided a starter drive 10 for an engine (not shown) mounted to a power shaft 12 of a starting motor (not shown). The starter drive 10 includes an axially extending sleeve 14 connected to the power shaft 12 by straight splines 16. The axially extending sleeve 14 is, therefore, axially but not rotatively movable relative to the power shaft 12. The external surface of the right-hand extremity of the axially extending sleeve 14, as illustrated, has external helical splines 18 formed thereon. A driving clutch member 20 has internal helical splines 19 threaded onto the external helical splines 18 of the axially extending sleeve 14. The driving clutch member 20 is, therefore, adapted for movement towards and away from a starting gear 22 of the engine to be started.

The driving clutch member 20 is illustrated in its engaged position in the drawing. In the engaged position, the driving clutch member 20 projects past the right end of the axially extending sleeve 14. The rightmost edge, as illustrated, of the internal helical splines 19 of the driving clutch member 20 form a radially inwardly extending shoulder 24, for a purpose to be described later.

A sleeve 28 is slidably supported on a reduced diameter portion 29 of the power shaft 12. One end of the sleeve 28 is secured to the axially extending sleeve 14. A pinion gear 26 is journaled on a bearing 63 which is press fit into the pinion gear 26. A lubrication groove 27 is located between the sleeve 28 and the bearing 63. The bearing 63, in turn, is slidably mounted on the sleeve 28 thereby permitting the pinion gear 26 to be axially and rotatably movable relative to the power shaft 12. The pinion gear 26 is structured for movement into and out of engagement with the starting gear 22 of the engine to be started.

A driven clutch member 30 is integrally formed with the pinion gear 26 and extends therefrom towards the driving clutch member 20. An internal circular recess 32 is provided in the driven clutch member 30 adjacent the driving clutch member 20. The internal circular recess 32 cooperates with the sleeve 28 to define an annular channel therebetween.

The adjacent faces of the driving clutch member 20 and driven clutch member 30 are provided with dentil teeth 34 and 36, respectively, which are complementary mutually engageable inclined torque transmitting dentil teeth. The dentil teeth 34 and 36 are of the sawtooth variety to provide a one-way overrunning clutch connection.

A housing 38 having an open end 39 and a closed end 40 is slidably supported at its closed end 40 on an external surface of the axially extending sleeve 14. The housing 38 is barrel-shaped and fitted over the driving clutch member 20 and partially over the driven clutch member 30. A lock ring 42 is seated in a groove 43 adjacent the open end 39 of the housing 38. The lock ring 42 has sufficient radial length to engage the driven clutch member 30 to thereby confine the driven clutch member 30 and the driving clutch member 20 within a cavity 41 of the housing 38.

The axially extending sleeve 14 is provided with a radial shoulder 44 in an intermediate location therealong to provide an abutment for a disk or washer 46 slidably journaled on the axially extending sleeve 14. A resiliently yieldable annular member 48, preferably formed of an elastically deformable material, such as rubber, is compressively confined between the washer 46 and the closed end 40 of the housing 38. A resilient spring member 50 is compressively confined within the cavity 41 of the housing 38 between the washer 46 and the driving clutch member 20 to provide a biasing force urging the driving clutch member 20 into engagement with the driven clutch member 30.

An advancement apparatus, not illustrated in the drawings but well known in the art, is provided for moving the starter drive 10 towards and away from the starting gear 22 of the engine.

The starter drive 10 is provided with a centrifugal flyweight clutch separator assembly, generally indicated by reference numeral 52, to effect disengagement of the driving clutch member 20 from the driven clutch member 30 when the engine is running above a predetermined speed. The centrifugal flyweight clutch separator assembly 52 thereby avoids excessive wear of the mutually engaging dentil clutch teeth 34 and 36.

The centrifugal flyweight clutch separator assembly 52 includes an annular thrust washer 54 disposed within the internal circular recess 32. Located between the annular thrust washer 54 and the annular shoulder 24 of the driving clutch member 20 is a loose thrust washer 67. A sleeve-like flyweight retainer 55 is also retained in the internal circular recess 32, forwardly of the annular thrust washer 54. It is preferred that the flyweight retainer 55 be constructed of molded plastic.

Figure 2:
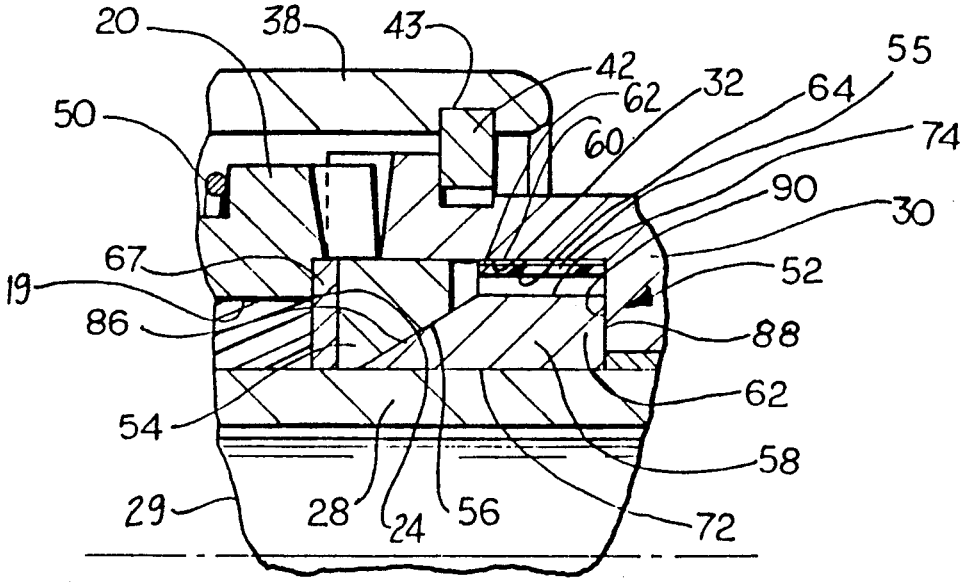
FIG. 2 is an enlarged fragmentary view of the engine starter gearing shown in FIG. 1.
Figure 3:
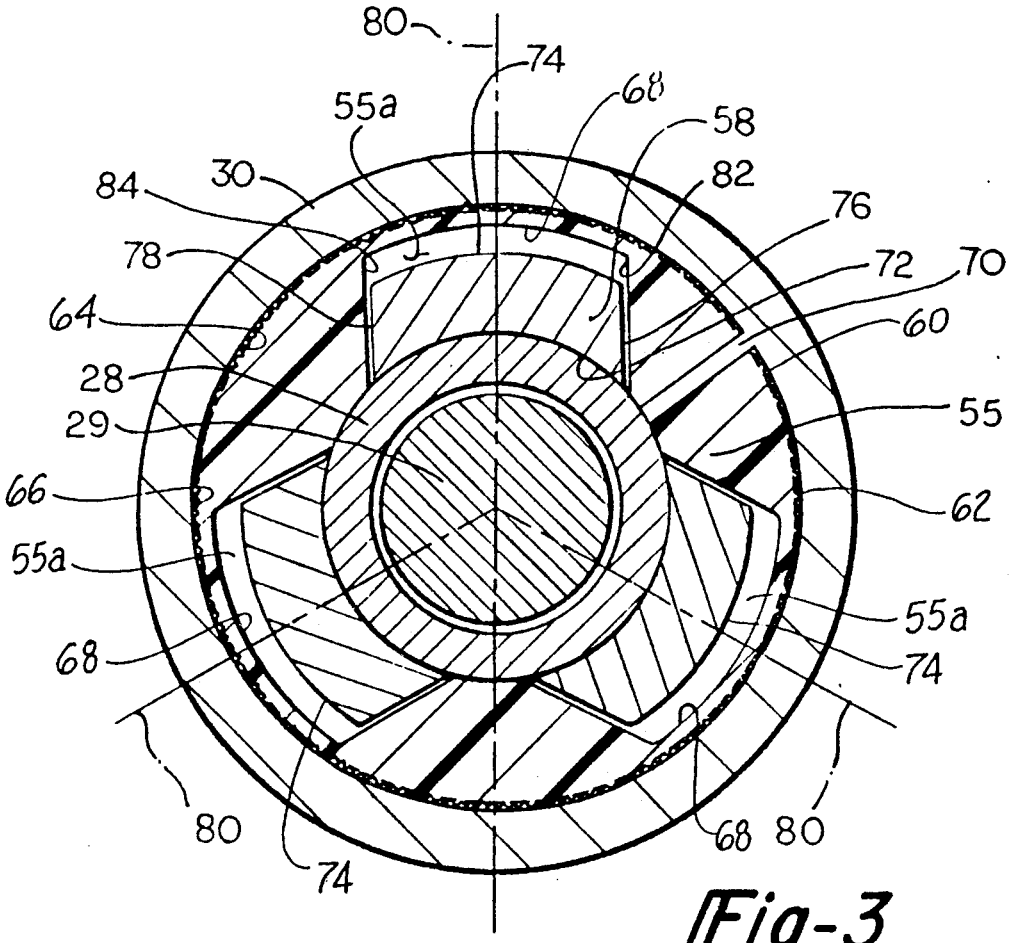
FIG. 3 is a cross-sectional view along line 3—3 of FIG. 1 at a somewhat enlarged scale relative to that of FIG. 1.
Figure 5:
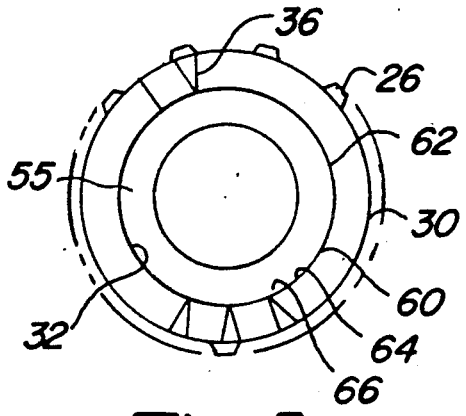
FIG. 5 is an end view of the driven clutch member along line 5—5 of FIG. 4.
Figure 4:
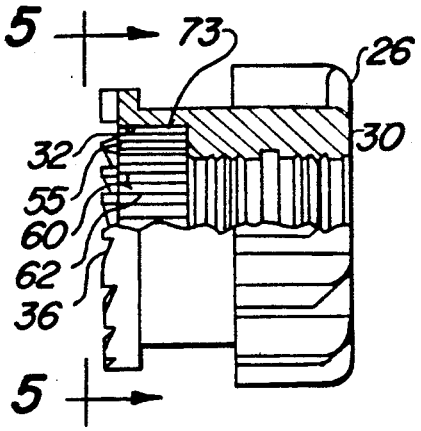
FIG. 4 is a side elevational view, partly in section, of the driven clutch member according to the present invention.

As seen in FIGS. 2 and 3, an outer surface 60 of the flyweight retainer 55 is provided with a circumferential plurality of splines 62 which engage a complementary circumferential plurality of splines 66 on an inside surface 64 of the driven clutch member 30 to accurately circumferentially orient and retain the flyweight retainer 55 with respect to the driven clutch member 30. As can be seen from FIG. 4, the splines 66 formed on the inside surface 64 of the driven clutch member 30 are located adjacent the dentil teeth 36. The inside surface 64 is generally circular and the splines 66 are preferably formed as shallow splines similar to a serrated or knurled surface.

The flyweight retainer 55 is annularly dimensioned to be inserted into the internal circular recess 32 of the driven clutch member 30 so that the outer surface 60 of the flyweight retainer 55 abuts the inside surface 64 of the driven clutch member 30. As can be seen from FIG. 6, the plurality of splines 62 are provided on the outer surface 60 of the flyweight retainer 55. These splines are complementary to the splines 66 on the inside surface of the driven clutch member and are preferably formed as shallow splines similar to a serrated or knurled surface.

Figure 6:
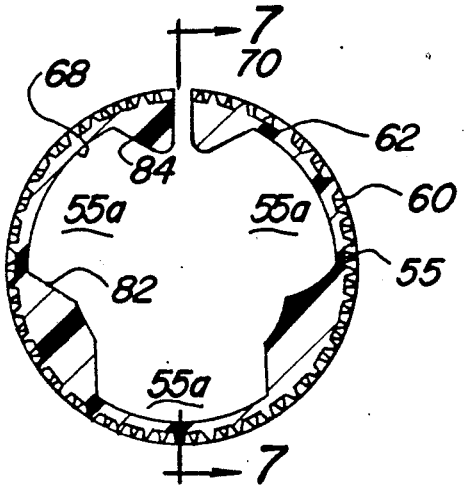
FIG. 6 is a cross-sectional end view of the flyweight retainer according to the present invention.

In order that the flyweight retainer 55 be insertable into the internal circular recess 32 of the driven clutch member 30 and located against a base surface 90, and yet be of sufficient cross-section so that its splines 62 may engage the splines 66 on the inside surface of the driven clutch member 30, the flyweight retainer 55 is provided with a slot 70 which permits it to be deformed during insertion into the driven clutch member. The slot 70 is located between spaced apart recesses **55*a*, as best shown in FIG. 6. The flyweight retainer 55 is made of a structurally strong yet resilient material, such as a structural plastic which permits deformation sufficient to seat the flyweight retainer 55 within the driven clutch member 30** and resume its original shape once it is seated therein.

In the preferred embodiment of the present invention, the splines 66 on the inside surface 64 of the driven clutch member 30 are located in a central portion 73 of the inside surface of the internal circular recess 32. Accordingly, once the flyweight retainer 55 is seated within the internal circular recess 32 against the base surface 90, the engagement of the splines 62 and 66 will cause the flyweight retainer 55 to be retained within the driven clutch member 30.

Figure 7:
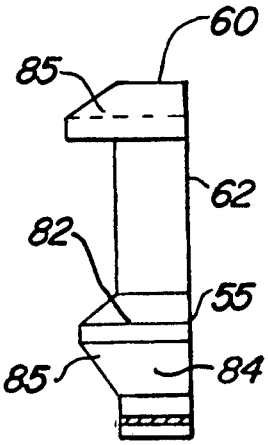
FIG. 7 is a cross-sectional side view of the flyweight retainer along line 7—7 of FIG. 6.

The flyweight retainer 55 also is provided on its inside surface with a circumferential series of the spaced-apart recesses **55*a*, as shown in FIGS. 3 and 6. Each recess 55*a* has a first and second retaining surface 82 and 84, respectively, which extend longitudinally in relation to the axis of the power shaft 12, the first and second retaining surfaces 82 and 84 being parallel to each other. As best seen in FIG. 7, a longitudinal projection 85 extends longitudinally from each of the first and second retaining surfaces 82 and 84** toward the driving clutch member 20 such that each longitudinal projection 85 is coplanar with its corresponding first retaining surface 82 or second retaining surface 84. The longitudinal projections 85 act as continuous extensions of the first and second retaining surfaces 82 and 84 in the longitudinal direction of the flyweight retainer 55 for a purpose to be described later.

A plurality of centrifugal flyweight members 58 are fitted in the spaced-apart recesses 55*a* of the flyweight retainer 55. A portion of each of the centrifugal flyweight members 58 extends into one of the spaced-apart recesses 55*a*. In fact, the major portion of each of the centrifugal flyweight members 58 is disposed within each of the spaced-apart recesses 55*a*.

As can be seen from FIGS. 2 and 3, each of the centrifugal flyweight members 58 is appropriately dimensioned for cooperation with the spaced-apart recess 55*a* in which it is located. Each of the centrifugal flyweight members 58 is also appropriately dimensioned for cooperation with a conical inner surface 56 of the annular thrust washer 54. Each spaced-apart recess 55*a* has an inside surface 68 which is spaced from the centrifugal flyweight member 58 so that the centrifugal flyweight member 58 can reciprocate radially, as will be explained below. Thus, each of the centrifugal flyweight members 58 has an inner surface 72 engaging the outer surface of the sleeve 28 and an outer surface 74 remote from the inner surface. Preferably, the inner surface 72 and the outer surface 74 are circular, cylindrically shaped, and concentric.

A first and second guide surface 76 and 78, respectively, are formed between the inner surface 72 and the outer surface 74 of each of the centrifugal flyweight members 58. The first and second guide surfaces 76 and 78 are flat and parallel to each other. Preferably, they are parallel to a radial plane 80 through the center of gravity of the centrifugal flyweight members. The first and second guide surfaces 76 and 78 cooperate with the first and second retaining surfaces 82 and 84 of the recesses 55*a* of the annular flyweight retainer 55 to guide the axial and radial reciprocal motion of the centrifugal flyweight members 58. Further, the first and second retaining surfaces 82 and 84 retain the centrifugal flyweight members 58 in the circumferential direction when the dentil clutch teeth 34 and 36 are engaged.

Each of the centrifugal flyweight members 58 is also provided with an inclined surface 86 extending inwardly and angularly away from the outer surface 74 towards the inner surface 72 thereof. The inclined surface 86 cooperates with the conical inner surface 56 of the annular thrust washer 54 to separate the dentil teeth 34 and 36, respectively, of the driving clutch member 20 and the driven clutch member 30 during an overrunning condition. The centrifugal flyweight members 58 are also provided with a third guide surface 88 disposed remote from the inclined surface 86 and extending perpendicular to each of the first and second guide surfaces 76 and 78 between the inner surface 72 and the outer surface 74. The third guide surface 88 cooperates with the base surface 90 of the internal circular recess 32. The base surface 90, therefore, acts as an abutment during the radial outward motion of the centrifugal flyweight members 58.

In operation, when it is desired to crank the engine, the starter drive 10 is shifted to the right via the shifting mechanism, not illustrated, so that the pinion gear 26 engages the starting gear 22. The power shaft 12 is rotated by a starting motor, not illustrated, and transmits torque through the straight splines 16 to the axially extending sleeve 14, and from the helical external splines 18 to the driving clutch member 20. The driving clutch member 20 drives the driven clutch member 30 through the dentil teeth 34 and 36. The driven clutch member 30 thereby rotates the pinion gear 26 and the starting gear 22 of the engine.

As the engine fires and becomes self-operating, the starting gear 22 will drive the pinion gear 26 at a speed greater than that of the power shaft 12. The dentil teeth 34 and 36 will slip so that the starting motor is not driven at a high engine speed. In order to protect the dentil teeth 34 and 36 from severe wear due to the rubbing and clashing which would otherwise occur, and further to avoid unnecessary noise, the rapid rotation of the driven clutch member 30 drives the centrifugal flyweight members 58 radially outwardly. The movement of each centrifugal flyweight member 58 is guided by the corresponding first and second retaining surfaces 82 and 84 of one of the recesses 55*a* of the annular flyweight retainer 55 so as to prevent any motion of the centrifugal flyweight members 58 relative to the driven clutch member 30 other than the desired radial motion.

The radially outward motion of the centrifugal flyweight members 58 will bring the inclined surface 86 of the centrifugal flyweight members 58 into engagement with the conical inner surface 56 of the annular thrust washer 54, urging the annular thrust washer 54 to the left against the biasing force of the resilient spring member 50, as illustrated in FIG. 1. This motion of the annular thrust washer 54 is transferred through the loose thrust washer 67 to the radially inwardly extending shoulder 24 of the driving clutch member 20, causing a separation between the driving clutch member 20 and the driven clutch member 30.

Of primary concern for purposes of the present invention, it is possible during the above overrunning condition for the centrifugal flyweight members 58 to migrate longitudinally toward the driving clutch member 20 and beyond the first and second retaining surfaces 82 and 84, which under non-overrunning conditions retains the centrifugal flyweight members 58 in the circumferential direction. For this reason, the longitudinal projections 85 extend sufficiently from their respective first and second retaining surfaces 82 and 84 such that the centrifugal flyweight members 58 remain retained within their respective recesses 55*a* even when at their extreme longitudinal limit of travel. Consequently, the centrifugal flyweight members 58 are incapable under any condition of moving circumferentially between the driving clutch member 20 and the driven clutch member 30, which would otherwise result in momentary slipping between the driving and driven clutch members 20 and 30, causing high peak torques which are capable of twisting the straight splines 16.

The starter drive 10 disclosed above has certain additional advantages over the prior art. It will be readily appreciated by those skilled in the art that the centrifugal flyweight members 58 are extremely easy and inexpensive to form, as compared with the prior art centrifugal flyweight members for starter drive gearing. Furthermore, the centrifugal flyweight members 58 are very strong and may be formed from materials which might even be inappropriate for the centrifugal flyweight members 58 described previously, thereby further increasing the number of materials which may be selected from for manufacturing this component.

Furthermore, precise dimensions may be provided in the recesses that are used to retain the flyweight members through the use of a molded plastic flyweight retainer 55 containing the recesses 55*a*, which thereby eliminates the need to resort to complex machining or cold-forming operations in an effort to form such precisely dimensioned recesses directly in the driven clutch member 30, which is normally formed from a hard metal because of the loads and wear that it is subjected to in normal service.

Importantly, because complementary splines are provided on both the outer surface of the flyweight retainer and the inside surface of the driven clutch member, there is no need to further machine the driven clutch member in order to provide for holding of the flyweight retainer; the splines may be rolled on during the machining process without requiring special tools or manufacturing processes. The flyweight retainer 55 is preferably formed from a hard, dimensionally resilient and stable thermoplastic material, such as a Nylon (polyamide) based material, and the flyweight retainer may be readily and inexpensively mass-produced from such a thermoplastic material by conventional injection molding practices and equipment.

Figure 9:
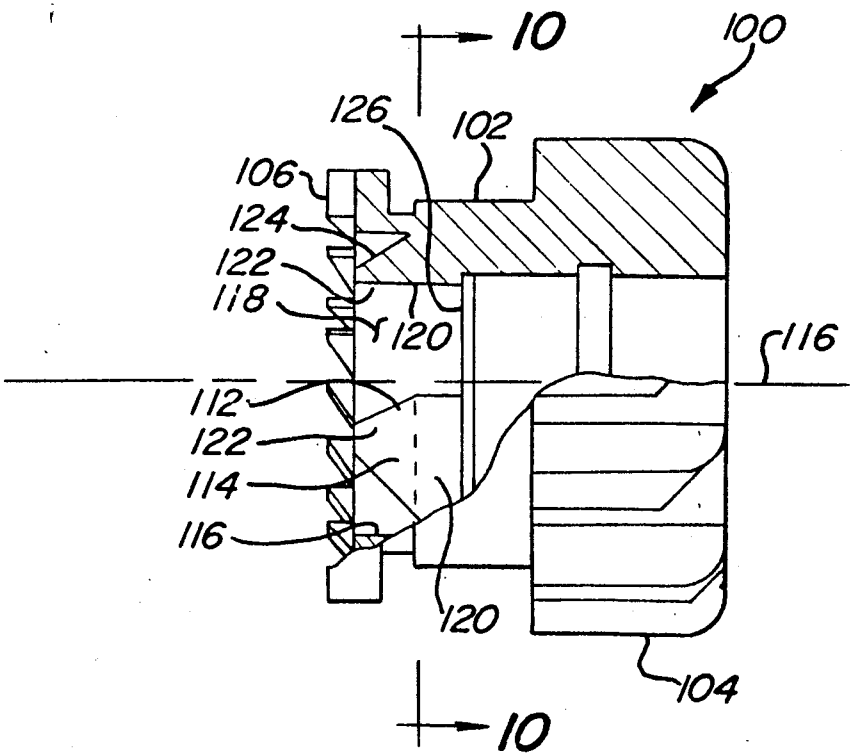
FIG. 9 is a partial cross-sectional side view of an alternate embodiment of the pinion gear.
Figure 10:
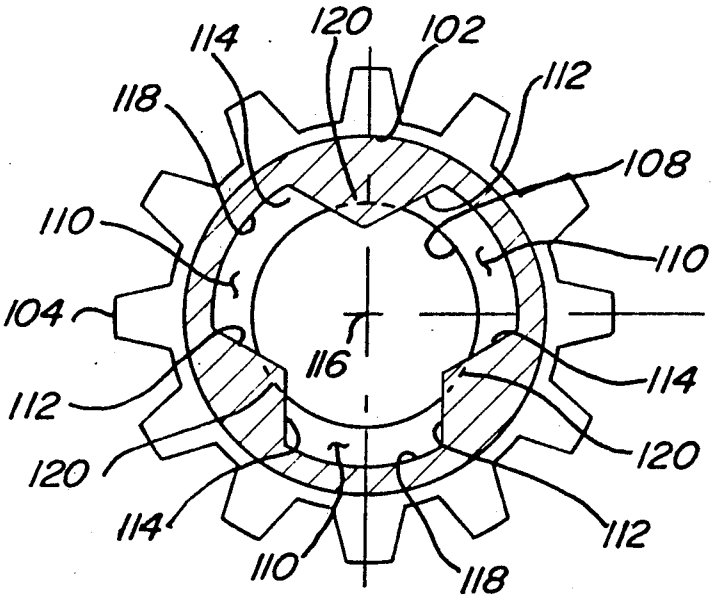
FIG. 10 is a cross-sectional end view of the pinion gear taken in the direction of arrows 10—10 of FIG. 9.

In an alternate embodiment of the engine starter gearing, the pinion gear 26, driven clutch member 30, and the flyweight retainer 55 may be formed as an integrated pinion gear 100 as shown in FIGS. 9 and 10. The integrated pinion gear 100 has a cylindrically-shaped sleeve portion 102 having a pinion gear 104 formed at one end which corresponds to the pinion gear 26 shown in FIG. 1, and dentil teeth 106 provided at the opposite end which correspond to the dentil teeth 36. The integrated pinion gear 100 has an axially disposed bearing bore 108 into which the sleeve bearing 63 is press fit. As described relative to FIG. 1, the integrated pinion gear 100 with the bearing 63 press fit into the bearing bore 108 is journaled on the sleeve 28. The internal surface of the bearing bore 108 may be grooved or serrated, as is known in the art, to facilitate the locking of the bearing 63 in the bearing bore 108.

Figure 8:
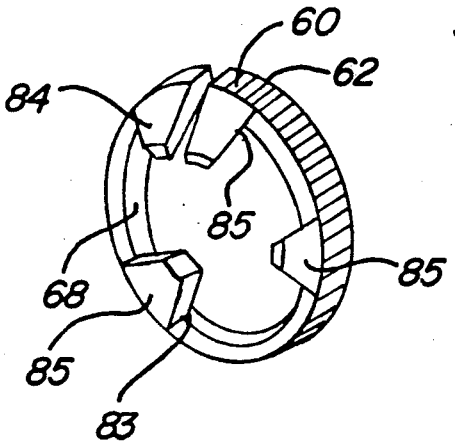
FIG. 8 is a perspective view of the flyweight retainer of the present invention.

Three equally spaced longitudinal flyweight recesses 110 are formed in the end of the sleeve portion 102 opposite the pinion gear 104. The flyweight recesses 110 are bounded on opposite sides by substantially parallel retaining surfaces 112 and 114 which extend longitudinally parallel to the axis of rotation 116 of the integrated pinion gear 100. The flyweight recesses 110 are structurally and functionally equivalent to the recesses 55*a* of the flyweight retainer 55 shown in FIG. 8. Intermediate the retaining surfaces 112 and 114 is a longitudinally extending flyweight abutment surface 118 which limits the radial displacement of the flyweight members 58 due to centrifugal forces. Preferably the flyweight abutment surfaces 118 have an arcuate cross section as shown in FIG. 10 having a center of curvature concentric with the axis of rotation 116. The retaining surfaces 112 and 114 and the flyweight abutment surfaces 118 terminate at a radially disposed base surface 126 formed at the end of each flyweight recess 110.

The flyweight recesses 110 are separated from each other by a web 120 bounded on opposite sides by the retaining surfaces 112 and 114. Each web 120 has a longitudinal projection 122 which corresponds to the projections 85 of the flyweight retainer 55 shown in FIGS. 6 through 8. External surfaces 124 of the longitudinal projections 122 incline toward the axis of rotation 116 and are segments of a truncated cone which mates with the conical inner surface 56 of the thrust washer 54. Thus when the dentil teeth 106 of the integrated pinion gear 100 are meshed with the dentil teeth 34 of the driving member 20, the conical inner surface 56 of the thrust washer 54 circumscribes the longitudinal projections 122 of the webs 120.

As discussed relative to the embodiment shown in FIGS. 1 through 8, the primary function of the projections 122 of the webs 120 is to retain the flyweight members 58 in their respective flyweight recesses 110 during an overrunning condition. The projections 122 prevent the flyweight members 58 from migrating in a longitudinal direction beyond the retaining surfaces 112 and 114 even when they are at their extreme longitudinal limit. Consequently, the flyweight members 58 are incapable under any condition of moving circumferentially between the driving clutch member 20 and the integrated pinion gear 100 and preventing re-engagement of the dentil teeth 34.

While the invention has been described in terms of a preferred embodiment, it is apparent that other forms could be adopted by one skilled in the art. Accordingly, the scope of the invention is to be limited only by the following claims.

What is claimed is:

1. An engine starter gearing for selectively starting an engine having a starting gear, comprising:

a power shaft having an axis of rotation;

a sleeve slidably, but non-rotatably, secured to said power shaft, said sleeve having external helical splines formed on one extremity thereof;

a pinion gear slidably journaled to said power shaft for axial movement relative thereto, said pinion gear structured for movement into and out of engagement with said starting gear of said engine to be started;

a driving clutch member slidably mounted on said sleeve, said driving clutch member having an internal helical spline engaging said external helical splines formed on said sleeve;

a driven clutch member integral with said pinion gear disposed adjacent to said driving clutch member, said driven clutch member having at least three equally spaced longitudinal flyweight recesses provided at an end thereof adjacent to said driving clutch member, said flyweight recesses being separated from each other by longitudinal webs, each longitudinal web having a projection longitudinally extending towards said driving clutch member, said projections having external surfaces which are inclined towards said axis of rotation of said power shaft;

complementary mutually engageable inclined teeth for transmitting torque therebetween in one direction of rotation provided on facing surfaces of said driving and driven clutch members;

a housing having an open end, said housing being slidably supported on said sleeve and spatially encompassing said driving clutch member and a portion of said driven clutch member;

abutment means disposed within said housing for retaining said driving clutch member and said portion of said driven clutch member within said housing;

resilient means disposed within said housing for biasing said driving clutch member towards said driven clutch member and said complementary mutually engageable inclined teeth into mutual engagement;

a radially inwardly extending shoulder provided on said driving clutch member adjacent said driven clutch member;

an annular thrust washer having an internal conical surface circumscribing said projections of said driven clutch member, said annular thrust washer operative to engage said radially inwardly extending shoulder and axially displace said driving clutch member when said annular thrust washer is axially displaced away from said projections; and a centrifugal flyweight member disposed in each of said at least three equally spaced longitudinal flyweight recesses, said centrifugal flyweight member having an inclined surface abutting said internal conical surface of said annular thrust washer, each said centrifugal flyweight member being operative to be radially displaced in response to centrifugal forces generated by a high speed rotation of said driven clutch member, said radial displacement of said centrifugal flyweight members axially displacing said annular thrust washer and said driving clutch member in a direction away from said driven clutch member, said axial displacement of said driving clutch member from said driven clutch member disengaging said complementary mutually engageable inclined teeth, said projections of said longitudinal webs retaining each said centrifugal flyweight member in a respective said at least three equally spaced longitudinal flyweight recess when said annular thrust washer is displaced in said direction away from said driven clutch member.

2. The engine starter gearing of claim 1 wherein said at least three equally spaced longitudinal flyweight recesses comprises three flyweight recesses.

3. The engine starter gearing of claim 1 wherein said at least three equally spaced longitudinal flyweight recesses, said longitudinal webs, and said projections are integrally formed in said driven clutch member.

4. The engine starter gearing of claim 1 wherein said driven clutch member has an internal recess provided at said end adjacent to said driving clutch member and wherein said at least three equally spaced longitudinal flyweight recesses, said longitudinal webs and said projections are provided on a flyweight retainer non-rotatably received in said internal recess.

5. The engine starter gearing of claim 4 wherein said internal recess of said driven clutch member has splines provided on its internal surface and said flyweight retainer has a mating set of said splines non-rotatably connecting said flyweight retainer to said driven clutch member.

6. The engine starter gearing of claim 5 wherein said flyweight retainer is made from a dimensionally resilient and stable thermoplastic.

7. The engine starter gearing of claim 6 wherein said flyweight retainer further comprises a longitudinal slot provided through one of said longitudinal webs to permit dimensional deformation of said flyweight retainer to facilitate the insertion of said flyweight retainer in said internal recess.

8. The engine starter gearing of claim 1 wherein each said centrifugal flyweight member has a center of gravity disposed within its associated flyweight recess.

9. An engine starter gearing for selectively starting an engine having a starting gear, said engine starter gearing comprising:

a power shaft;

a sleeve slidably, but non-rotatably, secured to said power shaft, said sleeve having external helical splines formed on one extremity thereof;

a pinion gear slidably journaled to said power shaft for axial movement relative thereto, said pinion gear being structured for movement into and out of engagement with said starting gear of said engine to be started;

a driving clutch member slidably mounted on said helical splines of said sleeve;

a driven clutch member secured to said pinion gear for movement therewith, said driven clutch member having an internal recess formed therein, said internal recess having an inside surface, said internal recess terminating inwardly in a base surface perpendicular to said inside surface, said driving and driven clutch members having complementary mutually engageable inclined teeth for transmitting torque therebetween in one direction of rotation;

a flyweight retainer seated within said internal recess formed in said driven clutch member, said flyweight retainer having an exterior surface and an interior surface, said exterior surface of said flyweight retainer being non-rotatably engaged with said inside surface of said internal recess of said driven clutch member;

a plurality of cavities annularly arranged on said interior surface of said flyweight retainer, each of said plurality of cavities having first and second retaining surfaces extending longitudinally thereon, said second retaining surface being parallel to said first retaining surface, each of said first and second retaining surfaces having a longitudinal projection extending towards said driving clutch member;

a housing having an open end, said housing being slidably supported on said sleeve and spatially encompassing said driving and driven clutch members;

abutment means disposed within said housing adjacent said open end thereof, said abutment means being structured for engagement with said driven clutch member for confining said driving and driven clutch members within said housing;

resilient means disposed within said housing, said resilient means abutting said driving clutch member, said resilient means further biasing said driving and driven clutch members into mutual engagement;

a radially inwardly extending shoulder formed on said driving clutch member adjacent said internal recess of said driven clutch member;

an annular thrust washer loosely disposed in said internal recess of said driven clutch member, said annular thrust washer having an inner conical surface, said annular thrust washer being structured to abut said radially inwardly extending shoulder of said driving clutch member when said annular thrust washer is displaced in a first axial direction; and a plurality of centrifugal flyweight members annularly arranged within said flyweight retainer, each of said plurality of centrifugal flyweight members having an inclined surface abutting said inner conical surface of said annular thrust washer, said plurality of centrifugal flyweight members being operative to displace said annular thrust washer in said first axial direction in response to centrifugal force;

each cavity of said plurality of cavities slidably receiving at least a portion of a respective centrifugal flyweight member of said plurality of centrifugal flyweight members between said first and second retaining surfaces to prevent circumferential movement of said plurality of centrifugal flyweight members while permitting radial movement thereof when said complementary mutually engageable inclined teeth of said driving and driven clutch members are engaged for transmitting torque therebetween in one direction of rotation, said longitudinal projection of said first and second retaining surfaces preventing circumferential movement of said plurality of centrifugal flyweight members when said annular thrust washer is displaced in said first axial direction, said complementary mutually engageable inclined teeth of said driving and driven clutch members being disengaged.

10. The engine starter gearing of claim 9 wherein said at least a portion of said respective centrifugal flyweight member disposed in each of said plurality of cavities is substantially axially aligned with the center of gravity of said respective centrifugal flyweight member.

11. The engine starter gearing of claim 9 wherein said flyweight retainer is made of dimensionally resilient and stable thermoplastic material.

12. The engine starter gearing of claim 11 wherein said flyweight retainer has a slot for permitting dimensional deformation of said flyweight retainer so that said flyweight retainer may be seated within said internal recess of said driven clutch member.

13. The engine starter gearing of claim 9 further comprising stop means movable with said pinion gear and said driven clutch member to provide a radially inward abutment stop for said plurality of centrifugal flyweight members.

14. The engine starter gearing of claim 9 wherein said plurality of centrifugal flyweight members comprises three centrifugal flyweight members and said plurality of cavities comprises three cavities.

15. The engine starter gearing of claim 9 wherein said internal recess of said driven clutch member is circular, said inside surface of said internal recess having splines formed thereon, and wherein said exterior surface of said flyweight retainer has splines formed thereon, said splines on said inside surface of said internal recess of said driven clutch member engaging said splines on said exterior surface of said flyweight retainer.

16. The engine starter gearing of claim 15 wherein said splines formed in said inside surface of said internal recess of said driven clutch member are present only in a central portion of said inside surface of said internal recess.

17. The engine starter gearing of claim 16 wherein said splines formed in said inside surface of said internal recess form a serrated surface and said splines formed in said exterior surface of said flyweight retainer form a serrated surface.

18. The engine starter gearing of claim 9 wherein said plurality of centrifugal flyweight members comprises a unitary member comprising:

an inner surface disposed adjacent said sleeve, said inner surface having a partial circular cylindrical shape;

an outer surface disposed remote from said inner surface;

a first guiding surface extending between said inner surface and said outer surface, said first guiding surface being flat, said first guiding surface being adjacent said first retaining surface of one of said plurality of cavities formed in said interior surface of said flyweight retainer;

a second guiding surface extending between said inner surface and said outer surface, said second guiding surface being flat and parallel to said first guiding surface, said second guiding surface being adjacent said second retaining surface of said one of said plurality of cavities formed in said interior surface of said flyweight retainer, said inclined surface being formed between said outer surface and said inner surface and between said first and second guiding surfaces; and a third guiding surface extending between said inner surface and said outer surface remote from said inclined surface, said third guiding surface being perpendicular to each of said first and second guiding surfaces and extending therebetween, said third guiding surface being adjacent said base surface of said driven clutch member.

19. The engine starter gearing of claim 18 wherein said first and second guiding surfaces are parallel to the radial plane through the center of gravity of each centrifugal flyweight member of said plurality of centrifugal flyweight members.

20. The engine starter gearing of claim 19 wherein said outer surface has a partial circular cylindrical shape that is concentric with said inner surface.

21. In a centrifugally disengageable engine starter gearing for selectively starting an engine having a starting gear, said engine starter gearing having a power shaft, a sleeve slidably secured to said power shaft, a pinion gear slidably mounted to said power shaft and movable into engagement with said starting gear, a driven clutch member secured to said pinion gear and having an internal recess therein, a flyweight retainer having an inside and an outside surface, said inside surface of said flyweight retainer having a plurality of cavities, each of said plurality of cavities having a first and second retaining surface extending longitudinally, said second retaining surface being parallel to said first retaining surface, said flyweight retainer being seated in said internal recess of said driven clutch member, a plurality of flyweight members, each flyweight member of said plurality of flyweight members having an inclined surface, said plurality of flyweight members being annularly arranged wherein one of said plurality of flyweight members is in each cavity of said plurality of cavities in said flyweight retainer, a driving clutch member mounted to said sleeve, mutually engageable teeth on said driving and driven clutch members, a housing fitted over said driving and driven clutch members, an abutment confining said driving and driven clutch members within said housing, a resilient member biasing said driving and driven clutch members into mutual engagement, a radially inwardly extending shoulder on said driving clutch member adjacent said internal recess, an annular thrust washer having an inner conical surface abutting said inclined surface of each of said plurality of flyweight members, said annular thrust washer abutting a loose washer which, in turn, abuts said radially inwardly extending shoulder of said driving clutch member, said first and second retaining surfaces of said plurality of cavities cooperating with at least a portion of each of said plurality of flyweight members to prevent circumferential movement of said plurality of flyweight members while permitting radial movement thereof when said mutually engageable teeth of said driving and driven clutch members are engaged for transmitting torque therebetween in one direction of rotation, the improvement comprising:

a longitudinal projection extending from each of said first and second retaining surfaces towards said driving clutch member, said longitudinal projection being of sufficient longitudinal length to prevent circumferential movement of said plurality of centrifugal flyweight members when said annular thrust washer is displaced in a direction away from said plurality of flyweight members and when said mutually engageable teeth of said driving and driven clutch members are disengaged.

22. The engine starter gearing of claim 21 wherein said flyweight retainer is made of dimensionally resilient and stable thermoplastic material.

23. The engine starter gearing of claim 21 wherein said internal recess of said driven clutch member has a circular inside surface, said circular inside surface of said internal recess having splines formed thereon, and wherein said outside surface of said flyweight retainer has splines formed thereon, said splines on said circular inside surface of said internal recess of said driven clutch member engaging said splines on said outside surface of said flyweight retainer.

24. The engine starter gearing of claim 23 wherein said splines formed in said circular inside surface of said internal recess of said driven clutch member are present only in a central portion of said circular inside surface of said internal recess.

25. The engine starter gearing of claim 24 wherein said flyweight retainer has a slot for permitting dimensional deformation of said flyweight retainer so that said flyweight retainer may be seated within said internal recess of said driven clutch member.

26. The engine starter gearing of claim 21 wherein said circular inside surface of said internal recess is a serrated surface and said outside surface of said flyweight retainer is a serrated surface.

27. An engine starter gearing for selectively starting an engine having a starting gear, said engine starter gearing comprising:

a power shaft having an axis of rotation;

a sleeve slidably, but non-rotatably, secured about said power shaft concentric with said axis of rotation, said sleeve having external helical splines formed on one extremity thereof;

a driving clutch member slidably mounted on said sleeve, said driving clutch member having internal helical splines engaging said external helical splines of said sleeve and a first set of inclined teeth of a pair of complementary mutually engageable inclined sets of inclined teeth provided at one end thereof;

a driven clutch member having a clutch axis of rotation concentric with said axis of rotation of said power shaft slidably journaled on said power shaft, said driven clutch member having one end adjacent to said driving clutch member and an opposite end, said one end having a second set of inclined teeth of said pair of complementary mutually engageable inclined sets of inclined teeth which mates with said first set of inclined teeth of said pair of complementary mutually engageable inclined sets of teeth, said opposite end having a pinion gear provided thereon, said pinion gear axially displaceable with said driven clutch member into and out of engagement with said starting gear of said engine, said driven clutch member further having at least three flyweight recesses provided adjacent to said one end, said at least three flyweight recesses being equally spaced about said clutch axis of rotation, said at least three flyweight recesses being separated from each other by longitudinal webs having side surfaces, each longitudinal web having a projection longitudinally extending towards said driving clutch member, each said projection having side surfaces which are longitudinal extensions of said side surfaces of said web and an external surface inclined towards said clutch axis of rotation;

a housing having an open end slidably supported on said sleeve, said housing spatially encompassing said driving clutch member and circumscribing a portion of said driven clutch member;

abutment means disposed within said housing adjacent said open end thereof, said abutment means rotatably engaging said driven clutch member to confine said driving clutch member and said portion of said driven clutch member within said housing;

resilient means disposed within said housing for biasing said driving clutch member towards said driven clutch member to engage said first set of inclined teeth of said pair of complementary mutually engageable inclined sets of teeth with said second set of inclined teeth of said pair of complementary mutually engageable inclined sets of teeth;

a radially inwardly extending shoulder provided on said driving clutch member adjacent said at least three flyweight recesses of said driven clutch member;

an annular thrust washer loosely disposed in said internal recess of said driven clutch member, said annular thrust washer having an inner conical surface provided at one end circumscribing said projections, the opposite end of said annular thrust washer abutting said radially inwardly extending shoulder of said driving clutch member when said annular thrust washer is displaced in a first axial direction; and a centrifugal flyweight member within each of said at least three flyweight recesses, said centrifugal flyweight member having an inclined surface abutting said inner conical surface of said annular thrust washer, said centrifugal flyweight member disposed in each of said at least three flyweight recesses being operative to be radially displaced within said flyweight recess in response to said driven clutch member being driven at a rotational speed greater than a predetermined rotational speed, said radial displacement of each said centrifugal flyweight member causing said annular thrust washer to be displaced in said first axial direction, said projection of said longitudinal webs preventing circumferential movement of each said centrifugal flyweight member when said annular thrust washer is displaced and said complementary mutually engageable inclined teeth of said driving and driven clutch members are disengaged.

28. The engine starter gearing of claim 27 wherein said at least three flyweight recesses are three flyweight recesses.

29. The engine starter gearing of claim 27 wherein each of said at least three flyweight recesses have a radial end wall which limits the axial displacement of said centrifugal flyweight members in a direction away from said one end of said driven clutch member.

30. The engine starter gearing of claim 27 wherein said external surfaces of said projections are curved surfaces, said curved surfaces being segments of a truncated conical surface.

* * * * *